US005226546A

United States Patent [19]

Janssens et al.

[11] Patent Number: 5,226,546

[45] Date of Patent: Jul. 13, 1993

[54] CIRCULAR VIBRATORY SCREEN SEPARATOR

[75] Inventors: Eduard X. J. Janssens, Wolvertem; Christian M. J. C. M. Minne, Bracquegnies, both of Belgium

[73] Assignee: Sweco, Incorporated, Florence, Ky.

[21] Appl. No.: 697,317

[22] Filed: May 6, 1991

[51] Int. Cl.[5] ..... B07B 1/28

[52] U.S. Cl. ..... 209/319; 209/399; 209/403

[58] Field of Search ..... 209/313, 315, 319, 399, 209/403

[56] References Cited

U.S. PATENT DOCUMENTS

| | | | |
|---|---|---|---|
| 2,777,578 | 1/1957 | Miller et al. | 209/315 X |
| 2,959,285 | 11/1960 | Tonjes et al. | 209/319 |
| 3,035,700 | 5/1962 | McCausland | 209/319 X |
| 3,139,400 | 6/1964 | Kyle | 209/403 |
| 3,968,033 | 7/1976 | Illemann et al. | 209/319 X |
| 4,582,597 | 4/1986 | Huber | 209/313 |
| 4,744,898 | 5/1988 | Bailey | 209/399 X |
| 4,810,372 | 3/1989 | Jones | 209/323 X |
| 4,816,153 | 3/1989 | Ando et al. | 209/319 X |

FOREIGN PATENT DOCUMENTS

| | | | |
|---|---|---|---|
| 0130744 | 1/1985 | European Pat. Off. | 209/403 |
| 3825837 | 1/1990 | Fed. Rep. of Germany | 209/403 |
| 0445480 | 4/1975 | U.S.S.R. | 209/315 |
| 2176425 | 12/1986 | United Kingdom | 209/403 |

*Primary Examiner*—Robert P. Olszewski
*Assistant Examiner*—James R. Bidwell
*Attorney, Agent, or Firm*—Lyon & Lyon

[57] ABSTRACT

A circular vibratory screen separator having a separator housing resiliently mounted to a base. A vibratory generator is mounted to the housing for vibratory screen separation. Semicircular slots are cut through the sidewall of the housing normal to the axial centerline thereof. An inflatable seal is positioned about the inner periphery of the separator just below the slot. A stop is located just above the slot such that tension screens may be positioned through the slot into position between an inflatable seal and a stop. Strap ties extend across these slots and are fixed to the wall of the housing such that they are in tension when the inflatable seals are inflated.

26 Claims, 2 Drawing Sheets

CIRCULAR VIBRATORY SCREEN SEPARATOR

BACKGROUND OF THE INVENTION

The field of the present invention is separators for screening materials using vibratory motion for enhanced screening.

Vibratory separators have long been used for the multiple separation of materials, both wet and dry. The separators have been classically divided into rectangular screen separators and circular screen separators. An example of a rectangular screen separator is illustrated in U.S. Pat. No. 4,582,597 to Huber. This disclosed rectangular separator is particularly pertinent to the present invention and the disclosure thereof is incorporated herein by reference. A circular separator is illustrated in U.S. Pat. No. 4,613,432 to Racine et al., the disclosure of which is also incorporated herein by reference. Each type of separator has its own advantages well known in the industry.

The rectangular separator illustrated in U.S. Pat. No. 4,582,597 provides for advantageous mounting of rectangular screens. The device includes guideways for receiving the rectangular screens defined by an inflatable seal positioned under and displaced from a stop. The stop runs along two sides of the rectangular separator with the inflatable seal running along four sides. Thus, a screen mounted within the slot is constrained by two stops along opposite sides with a pneumatic seal extending about the full frame. This system allows for easy mounting with the inflatable seal in the deflated state and for sealing around the edges of the screen frame to avoid material bypassing the screen with the inflatable seal in the inflated condition.

The use of an inflatable seal system as in U.S. Pat. No. 4,582,597 has not been found advantageous in circular vibratory screen separators. Typically circular screen separators are built up by several sections which are stacked one upon another with screens located therebetween. The entire assembly is then securely clamped with clamp bands to hold the assembly together during vibration. An example of such construction is illustrated in U.S. Pat. No. 4,810,372 to Jones, the disclosure of which is incorporated herein by reference.

This stacked assembly has been found to allow access to the various screening levels. No means for positioning screens from the top without disassembling the separator housing has been found satisfactorily. Further, the clamp bands used on such stacked assemblies provide the structural support to withstand the induced vibrations. The tightening of such clamp bands, because of their angled channel structure, draws the stacked components together. This action compresses seals around screen frames to provide acceptable sealing against bypass flow. However, the use of clamp bands has become disfavored as assembly is convenient only with two or more operators helping to assemble or disassemble the separator housing.

The advantages of an inflatable seal system such as illustrated in U.S. Pat. No. 4,613,432 have not been realized in circular vibratory screen separators because of the need to rigidly hold the structure together. Far more rigid sealing gaskets are needed in the tight clamping of stacked components. An inflatable seal could not be involved in such clamping of components and, otherwise located, has been considered redundant.

SUMMARY OF THE INVENTION

The present invention is directed to a circular vibratory screen separator employing slots for receiving circular screens.

In a principal aspect of the present invention, each slot is associated with a stop and an inflatable seal, mutually opposed and displaced. A semicircular slot extends through the cylindrical separator housing to allow entry and removal of circular screens. Through such a system, the advantages of inflatable seals for retention and easy removal of screens and of sealing the periphery of the mounted screens can be realized.

In another aspect of the present invention, strap ties extend across the slots. These ties are tensioned by the inflation of the seals to establish sufficient structural integrity to resist the induced vibration in the separator. The seals would otherwise cause deformation of the slotted cylindrical separator housing. Further, the housing would ultimately fail without the structural rigidity of the strap ties because of the vibration loading on what otherwise would be considered cantilevered portions of the housing with stress raisers additionally developed by the slots themselves.

Thus, an object of the present invention is to provide an improved circular vibratory screen separator. Other and further objects and advantages will appear hereinafter.

DETAILED DESCRIPTION OF THE PREFERRED EMBODIMENT

Figure 1:
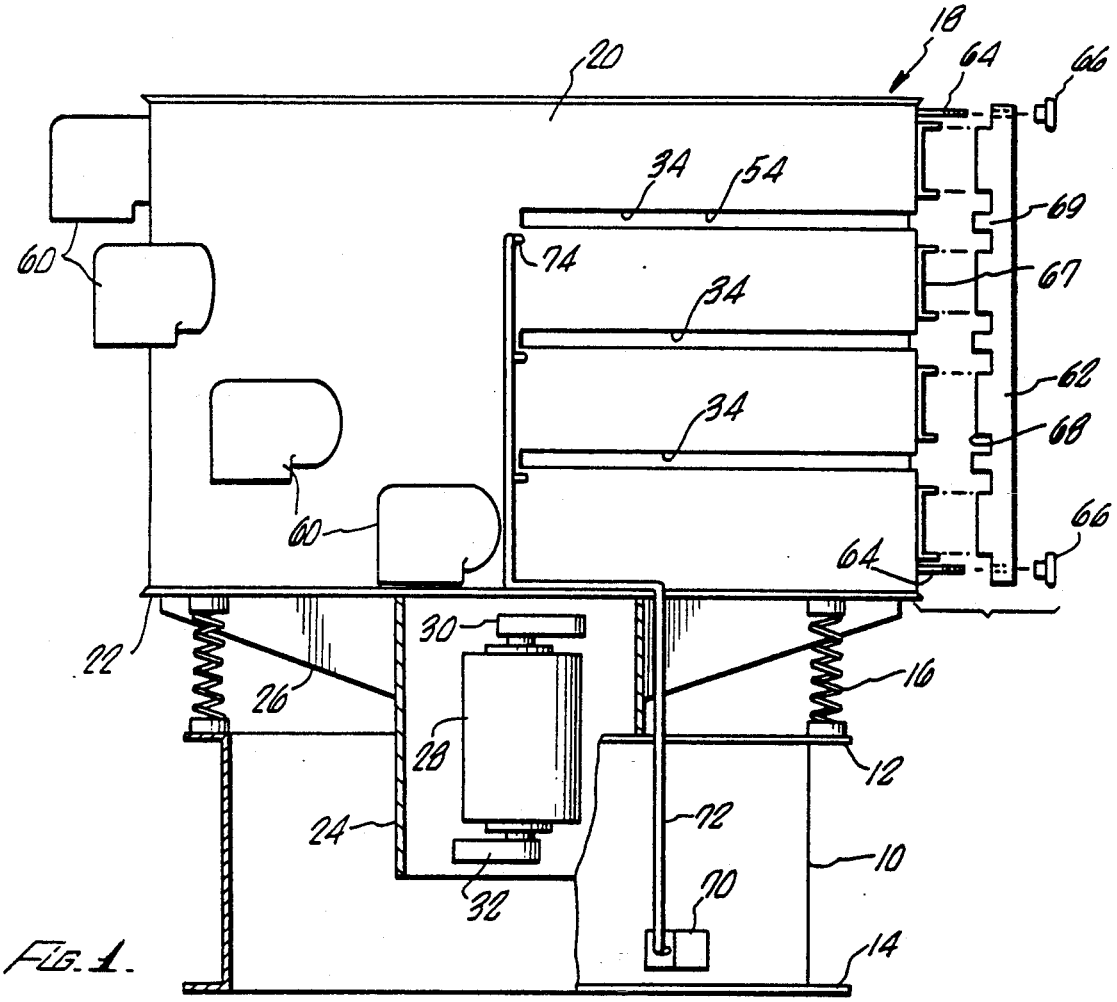
FIG. 1 is a side view of a circular vibratory screen separator of the present invention.

Turning in detail to the drawing, a circular vibratory screen separator is illustrated. This separator includes a base 10 which is conveniently cylindrical with mounting flange 12 and 14 located top and bottom. Affixed to the mounting flange 12 are springs 16. Resiliently mounted to the springs 16 is a separator housing, generally designated 18.

The separator housing 18 includes a cylindrical sidewall 20 and a circular base 22 to define a circular screening cavity. The housing 18 also includes a cylindrical motor housing 24 for mounting of a vibration generator. The motor housing 24 is positioned below the base 22 and gussets 26 support the lower structure. Mounted within the motor housing 24 is a vibration generator which includes a motor 28 with eccentrically mounted weights 30 and 3 mounted top and bottom on the motor shaft. Through rotation of the motor 28, the separator housing is vibrated to enhance screening within the screening cavity.

Screening levels are defined within the separator housing 18. These screening levels are capable of receiving screens for separating particles according to size. The circular screening cavity is divided at each of these levels by a circular screen which extends fully across the screening cavity and is sealed such that material does not circumvent the screen, but must either pass through the screen or be extracted from the separator above that screen. A variety of levels may be employed with all the versatility of current circular vibratory screen separators. Various screens configurations are also possible including self-cleaning screen assemblies and the like.

To define a screening level, the separator housing 18 includes a semicircular slot 34 extending therethrough. Being semicircular, the slot 34 extends halfway around the periphery of the separator housing 18 in a plane perpendicular to the axial centerline of the cylindrical housing 18. There are three such slots 34 illustrated in this preferred embodiment.

Figure 2:
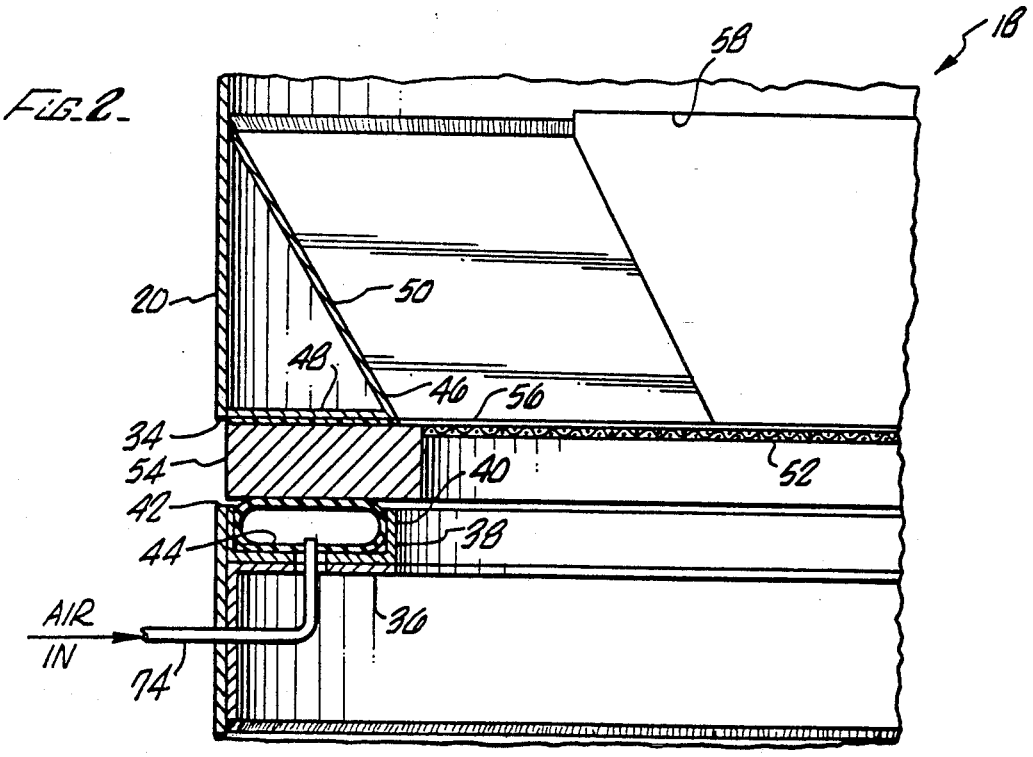
FIG. 2 is a cross-sectional detail of the side view of FIG. 1.
Figure 3:
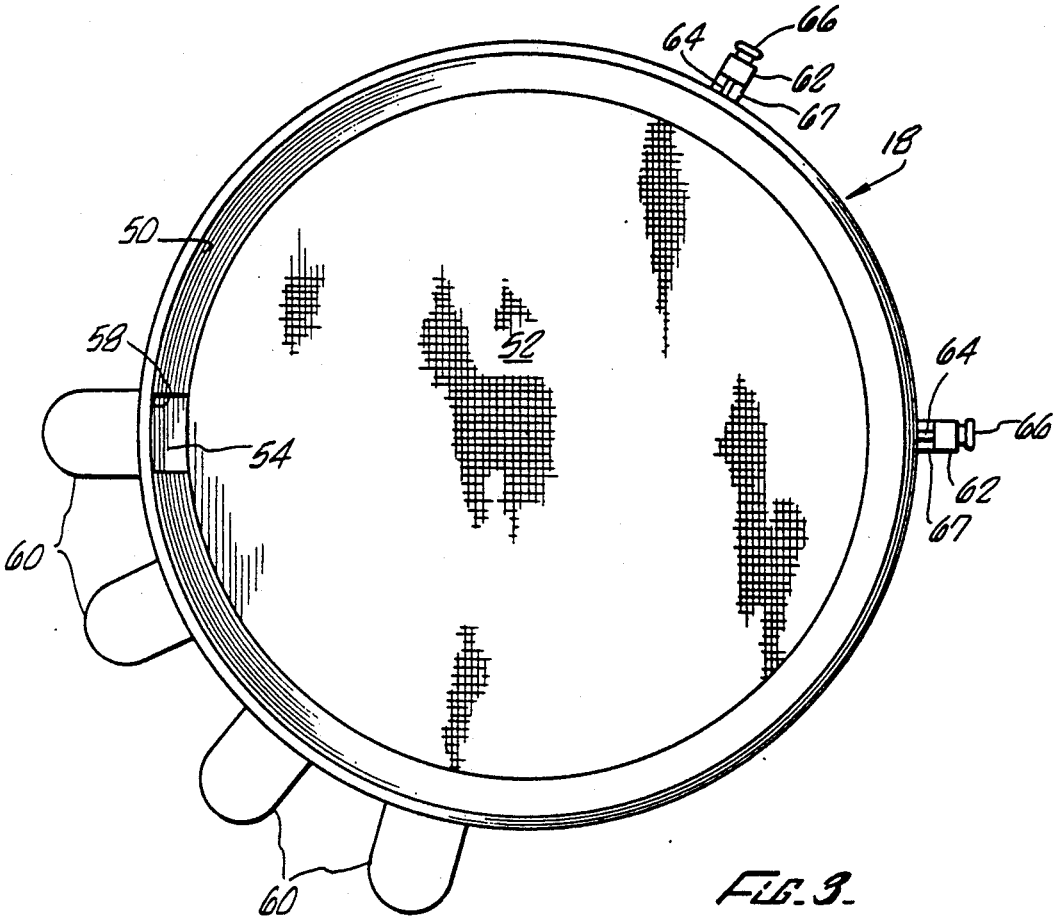
FIG. 3 is a plan view of the circular vibratory screen separator of FIG. 1.

About the internal circumference of the cylindrical sidewall 20 there is a flange 36. The flange 36 may extend continuously or may be intermittently spaced about the cylindrical sidewall 20 at one side of the semicircular slot 34. The flange 36 may be positioned flush with the semicircular slot 34 or displaced downwardly a small amount therefrom as seen in FIG. 2. Positioned on the flange 36 is a channel 38. The channel 38 may be positioned within the separator housing 18 on the flange 36 without being attached thereto. If the channel 38 is not attached, it may be easily removed for cleaning purposes. If it is found convenient, the channel 38 may be attached either permanently or through removable threaded fasteners. The channel 38 includes upstanding sides 40 and 42 to define a channel cavity. The channel 38 may also be defined by an upstanding cylindrical flange displaced inwardly from the cylindrical sidewall 20 fabricated with the flange 36. An inflatable tube 44 is positioned within the channel 38 to extend with the channel 38 fully about the inner periphery of the cylindrical sidewall 20 at the slot 34. This inflatable tube 44 associated with the channel 38 as positioned on the flange 36 defines an inflatable circular seal. It is also possible to construct the inflatable tube 44 such that the channel 38 is not required.

Located opposed to and displaced from the inflatable seal across the semicircular slot 34 is a stop 46. The stop 46, like the flange 36, is attached to the sidewall 20 of the separator housing 18. This stop 46 may be continuous about the inner periphery of the cylindrical sidewall 20 or may be positioned at intermittent locations. The stop 46 is shown in the preferred embodiment to have a flat lower plate 48 and a truncated conical section 50 for support. The flat lower plate 48 may be flush with the slot 34 as is illustrated in FIG. 2 or may be slightly displaced upwardly therefrom. At the discharge ports, and elsewhere if the stop 46 is intermittently placed, there are endwalls 51 to enclose the space within the lower plate 48 and the truncated conical section 50.

Positionable within the screen level defined by the slot 34, the inflatable seal and the stop 46 are circular tensioned screens. These tensioned screens include screen cloth 52 tensioned across a circular screen frame 54. The screen frame 54 fits closely within the cylindrical sidewall 20 between the inflatable tube 44, when in its deflated condition, and the stop 46. With the inflatable tube 44 deflated, the screen is easily positioned or removed without difficulty. A handle may be attached to the screen as a means to easily grip the screen for positioning or removal.

The screen frame 54 may be brought into engagement with the stop 46 with a gasket 56 therebetween. The gasket 56 prevents abrasive rubbing between the stop 46 and the screen frame 54. When the stop 46 extends fully along the semicircular slot 34, it may be used to form a sealing gasket to prevent leakage outwardly of the separator through the semicircular slot 34.

Additionally, the separator housing 18 includes discharge ports 58. These ports 58 include rectangular holes extending through the wall of the cylindrical sidewall 20. Once such discharge port 58 is located at each screening level such that material which does not pass through the screen cloth 52 may flow from the separator. Outwardly of the discharge ports 58, semicylindrical spouts 60 cover the discharge ports 58 and allow downward discharge of material coming off of the tensioned screen. To prevent material from flowing into any space that may exist between the screen frame 54 and the cylindrical sidewall 20 at the discharge port 58 and moving about that space to the slot 34, a gasket may be positioned in that space at least at the discharge port 58. Alternatively, the plate 48 may extend across the discharge port 58 without the truncated conical section 50. The gasket 56 may then provide the appropriate seal.

Strap ties 62 are located on the outside of the cylindrical sidewall 20. One or two such strap ties 62 or a continuous strap tie cover may be employed. The strap ties 62 employ outwardly extending threaded mounting studs 64 at the top and bottom of the sidewall 20. An alternative may be to have one end of each strap tie 62 hinged to the sidewall 20. Knobs 66 fasten the strap ties 62 to the sidewall 20. Sockets 67 receive extensions 68 on the strap ties 62 to retain the sections of the cylindrical sidewall 20 between the adjacent slots in fixed association with the strap ties 62. Resilient blocks 69 may be employed to insure proper seating of the screens before inflation. Strap ties spanning individual slots 34 may also be used.

The strap ties 62 are placed on the separator before the inflatable seals 44 are pressurized. When pressurized, the inflatable seals 44 vertically expand the cylindrical sidewall 20, placing the strap ties 62 in tension. The pressure in the seals 44 may be from 10 to 80 psi with 35 psi typical. This pressure is sufficient to retain the tension in the strap ties 62 during vibration. As a result, the dimensional integrity of the cylindrical sidewall 20 is retained and the strap ties 62 are preloaded to avoid distortion and nonelastic flexure during vibration.

In operation, the inflatable tubes 44 are found in a deflated form. Screens may be inserted into the slots 34 between the stops 46 and the inflatable seals. Because of the subsequent tensioning of the strap ties 62, a screen or spacer screen frame is preferably positioned in each slot. Once fully inserted, the strap ties 62 are positioned and locked down. With the blocks 69 positioned against the screens, the assembly is properly positioned. Next, the inflatable tubes 44 are pressurized with air. An air valve 70 and flexible coupling 72 extend to meet with tube valves 74 of the inflatable tubes 44 to provide pressurized air thereto. The inflation of the tubes forces the screen frames 54 up against the stops 46. This presses the gaskets 56 against the stops 46. This also presses the upper surfaces of the inflatable tubes 44 against the underside of each screen frame 54 to seal the screens against material passing around the screen into the next lower section. The tubes 44 also keep the screens in position during vibration of the separator.

Figure 4:
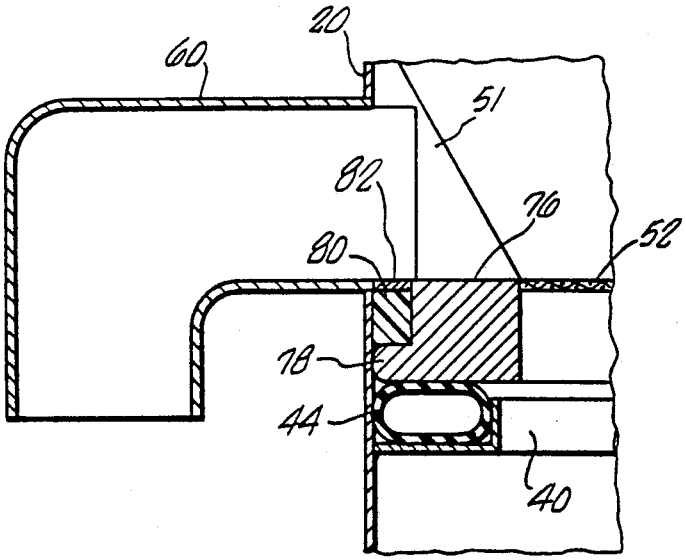
FIG. 4 is a cross-sectional view of a second embodiment of the present invention taken vertically through the device.
Figure 5:
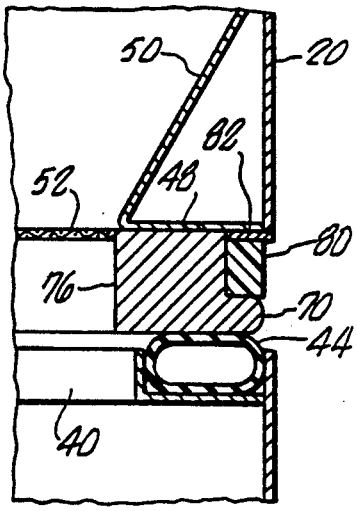
FIG. 5 is a cross-sectional view of a second embodiment of the present invention taken vertically through the device.

FIGS. 4 and 5 illustrate an alternate embodiment. In this embodiment, the screen frame 76 includes an outwardly extending integral flange 78 and a gasket 80. The gasket 80 is of semirigid elastomer such as hard rubber or urethane which may be either positioned on the screen frame 76 or molded in place into the step area defined by the integral flange 78. An inwardly extending flange 82 extends fully about the periphery of the cylindrical sidewall 20. The flange 82 may serve as the stop for the screen frame 54 or may work in conjunction with the stop 46. When inflated, the inflatable seal forces the gasket 80 up against the flange 82 to form a seal fully 360° about the sidewall. FIG. 4 illustrates this arrangement at the discharge ports 58 while FIG. 5 illustrates this arrangement at the semicircular slots 34.

Thus, an improved circular vibratory separator allowing easy screen replacement is disclosed. While preferred embodiments of the herein invention have been described, numerous modifications, alterations alternate embodiments and alternate materials may be contemplated by those skilled in the art and may be utilized in accomplishing the objects of the present invention. It is envisioned that all such alternates are considered to be within the scope of the present invention as defined by the appended claims.

What is claimed is:

1. A circular vibratory screen separator comprising a base;

a separator housing resiliently mounted to said base and including a cylindrical sidewall having a semicircular slot extending therethrough in a plane perpendicular to the axial centerline of said cylindrical sidewall, an inflatable seal extending fully about the inner circumference of said cylindrical sidewall and adjacent said slot, a stop adjacent said slot and extending about the inner circumference of said cylindrical sidewall, said stop being opposed to and displaced from said inflatable seal across said slot.

2. The circular vibratory screen separator of claim 1 further comprising a screen mounted in said separator housing between said inflatable seal and said stop, said screen including a screen frame and tensioned screen cloth mounted to said screen frame, said screen frame fitting closely within said separator housing.

3. The circular vibratory screen separator of claim 2 wherein said screen frame is compressed between said inflatable seal and said stop when said inflatable seal is inflated.

4. The circular vibratory screen separator of claim 3 further comprising a gasket positioned between said screen frame and said stop.

5. The circular vibratory screen separator of claim 1 wherein said inflatable seal includes a channel open toward said stop and an inflatable tube positioned in said channel.

6. The circular vibratory screen separator of claim 5 further comprising a pneumatic supply to said tube.

7. The circular vibratory screen separator of claim 1 further comprising a vibratory generator mounted to said housing.

8. The circular vibratory screen separator of claim 1 wherein there are a plurality of said slots, each said slot having adjacent thereto said inflatable seal and said stop.

9. The circular vibratory screen separator of claim 8 wherein said separator housing further includes discharge ports through said sidewall.

10. The circular vibratory screen separator of claim 9 wherein said stops do not extend across said exhaust ports.

11. A circular vibratory screen separator comprising a base;

a separator housing resiliently mounted to said base and including a cylindrical sidewall having a semicircular slot extending therethrough in a plane perpendicular to the axial centerline of said cylindrical sidewall, an inflatable seal extending fully about the inner circumference of said cylindrical sidewall adjacent said slot, a stop adjacent said slot and extending about the inner circumference of said cylindrical sidewall, said stop being opposed to and displaced from said inflatable seal across said slot;

a strap tie extending across said slot and being fixed at each end to said cylindrical sidewall.

12. The circular vibratory screen separator of claim 11 further comprising a screen mounted in said separator housing between said inflatable seal and said stop, said screen including a screen frame and tensioned screen cloth mounted to said screen frame, said screen frame fitting closely within said separator housing.

13. The circular vibratory screen separator of claim 12 wherein said screen frame is compressed between said inflatable seal and said stop when said inflatable seal is inflated.

14. The circular vibratory screen separator of claim 13 further comprising a gasket positioned between said screen frame and said stop.

15. The circular vibratory screen separator of claim 11 further comprising a vibratory generator mounted to said housing.

16. The circular vibratory screen separator of claim 11 wherein there are a plurality of said slots, each said slot having adjacent thereto a said inflatable seal and a said stop, said strap tie extending across said plurality of slots.

17. The circular vibratory screen separator of claim 16 wherein said separator housing further includes discharge ports through said sidewall.

18. The circular vibratory screen separator of claim 16 wherein said strap tie engages the cylindrical sidewall between adjacent said slots.

19. The circular vibratory screen separator of claim 11 wherein said strap tie includes a block extending to said slot for forced location of a screen positioned in said slot.

20. The circular vibratory screen separator of claim 11 further comprising a screen mounted in said separator housing between said inflatable seal and said stop, said screen including a screen frame and a tensioned screen cloth mounted to said screen frame, wherein said strap tie is in tension with said inflatable seal inflated.

21. A circular vibratory screen separator comprising a base;

a separator housing resiliently mounted to said base and including a cylindrical sidewall having a plurality of semicircular slots extending therethrough in a plane perpendicular to the axial centerline of said cylindrical sidewall, an inflatable seal extending fully about the inner circumference of said cylindrical sidewall adjacent each said slot, a stop extending about the inner circumference of said cylindrical sidewall, said stop being opposed to and displaced from said inflatable seal across said slot;

a strap tie extending across said slots and being fixed at each end to said cylindrical sidewall, a vibratory generator mounting to said housing.

22. The circular vibratory screen separator of claim 21 wherein said strap tie engages the cylindrical sidewall between adjacent said slots.

23. The circular vibratory screen separator of claim 21 wherein said strap tie includes blocks extending to said slots for forced location of screens positioned in said slots.

24. The circular vibratory screen separator of claim 21 further comprising screens mounted in said separator housing between adjacent said inflatable seals and said stops, said screens each including a screen frame and tensioned screen cloth mounted to said screen frame, each said screen frame fitting closely within said separator housing.

25. The circular vibratory screen separator of claim 24 further comprising gaskets between each said screen frame and an adjacent said stop.

26. The circular vibratory screen separator of claim 21 further comprising screens mounted in said separator housing between adjacent said inflatable seals and said stops, said screens each including a screen frame and tensioned screen cloth mounted to said screen frame, said strap tie being in tension with said inflatable seals inflated.

* * * * *